United States Patent [19]

Wolfe

[11] Patent Number: 4,576,087

[45] Date of Patent: Mar. 18, 1986

[54] AIR VENT FOR AN ARTICLE

[75] Inventor: Henry S. Wolfe, St. Petersberg, Fla.

[73] Assignee: Swell-Wear, Inc., New York, N.Y.

[21] Appl. No.: 689,646

[22] Filed: Jan. 8, 1985

[51] Int. Cl.[4] ..... A41D 3/04

[52] U.S. Cl. ..... 98/1; 2/87; 2/DIG. 1

[58] Field of Search ..... 2/87, DIG. 1; 98/1

[56] References Cited

U.S. PATENT DOCUMENTS

| | | | |
|---|---|---|---|
| 2,897,506 | 8/1959 | Carter | 2/87 |
| 3,703,432 | 11/1972 | Kuski | 2/87 X |
| 4,270,227 | 6/1981 | Wolfe | 2/DIG. 1 X |

FOREIGN PATENT DOCUMENTS

| | | | |
|---|---|---|---|
| 657775 | 3/1938 | Fed. Rep. of Germany | 2/87 |
| 161293 | 7/1933 | Switzerland | 2/87 |
| 20671 | of 1896 | United Kingdom | 2/87 |
| 2104770 | 3/1983 | United Kingdom | 2/DIG. 1 |

*Primary Examiner*—Harold Joyce

*Attorney, Agent, or Firm*—McAulay, Fields, Fisher, Goldstein & Nissen

[57] ABSTRACT

An air vent for an article of rainwear is provided wherein the article has at least a planar surface having an aperture therein. The air vent comprises a member which is provided with a rearwardly extending projection adapted to space the air vent from the wearer of the rainwear to permit the flow of air therethrough. A through opening is provided in the member and a forwardly projecting cover is similarly provided on the other side of the member which covers the opening to prevent the entry of rain therein. A peripheral flange on the member is adapted to engage the edges of the article adjacent the aperture to position the air vent in the aperture and to connect the same to the article of apparel.

7 Claims, 6 Drawing Figures

AIR VENT FOR AN ARTICLE

BACKGROUND OF THE INVENTION

The present invention relates generally to an air vent and, more specifically, pertains to an air vent that is specifically adapted to be connected to an article of the type covering a device, to provide means for the flow of air around the device and through the article.

Air vents for article such as wearing apparel which are adapted to enclose the body of the wearer and, in particular, rainwear, have been known in the past. These air vents are required because in order to provide rainwear that truly is waterproof, the article must be manufactured from a non-porous material or be coated with a non-permeable substance. As a result of the use of such materials any possibility of the circulation of air through the garment is substantially eliminated.

One prior solution has been the provision of holes under the arm where the natural orientation of the arm prevents the entry of water through the holes. These holes are usually reinforced by eyelets or the like. However, because of the natural tendency of the arm to lie against the body, these holes are normally sealed thereby defeating the purpose of the holes.

Other air vent constructions have been proposed which could be located at different points on the garment. However, some of these prior art air vents are of substantial length and produce an unsightly appearance. Other problems involved with such air vents are that they are difficult and expensive to produce and cause unsightly bulges in the articles to which they are attached. For example, U.S. Pat. No. 4,270,227 discloses an air vent that has a leg portion spaced from a member oriented perpendicular thereto and which also requires the provision of an elbow to be formed during the manufacturing process.

SUMMARY OF THE INVENTION

Accordingly, it is an object of the present invention to provide an air vent which is of minimum dimensions so that the article to which it is attached lies substantially flat against the body of the wearer.

A further object of the present invention is to provide an air vent of the type described which spaces the opening from the body of the wearer to provide for the free flow of air from the interior of the article to the environment and from the environment to the interior of the article.

A further object of the present invention is the provision of an air vent of the type described which is simple in construction and economical to produce.

Accordingly, an air vent constructed in accordance with the present invention is adapted to be utilized with, for example, rainwear wherein the rainwear has at least a planar surface which has an aperture therein. The air vent comprises a member having a rearwardly extending projection which is adapted to engage the person wearing the rainwear to space the air vent therefrom to permit the flow of air therethrough. A through opening is provided in the member in spaced relationship to the projection. A forwardly projecting cover is provided on the other side of the member to cover the opening to prevent the entry of rain therethrough. Additionally, a peripheral flange is provided on the member which is adapted to sealingly engage the edges of the article of rainwear adjacent the aperture to position the air vent in the aperture.

BRIEF DESCRIPTION OF THE DRAWINGS

Other features and advantages of the present invention will become apparent from a consideration of the following detailed description, when taken in connection with the accompanying drawings in which.

DETAILED DESCRIPTION OF THE INVENTION

Figure 1:
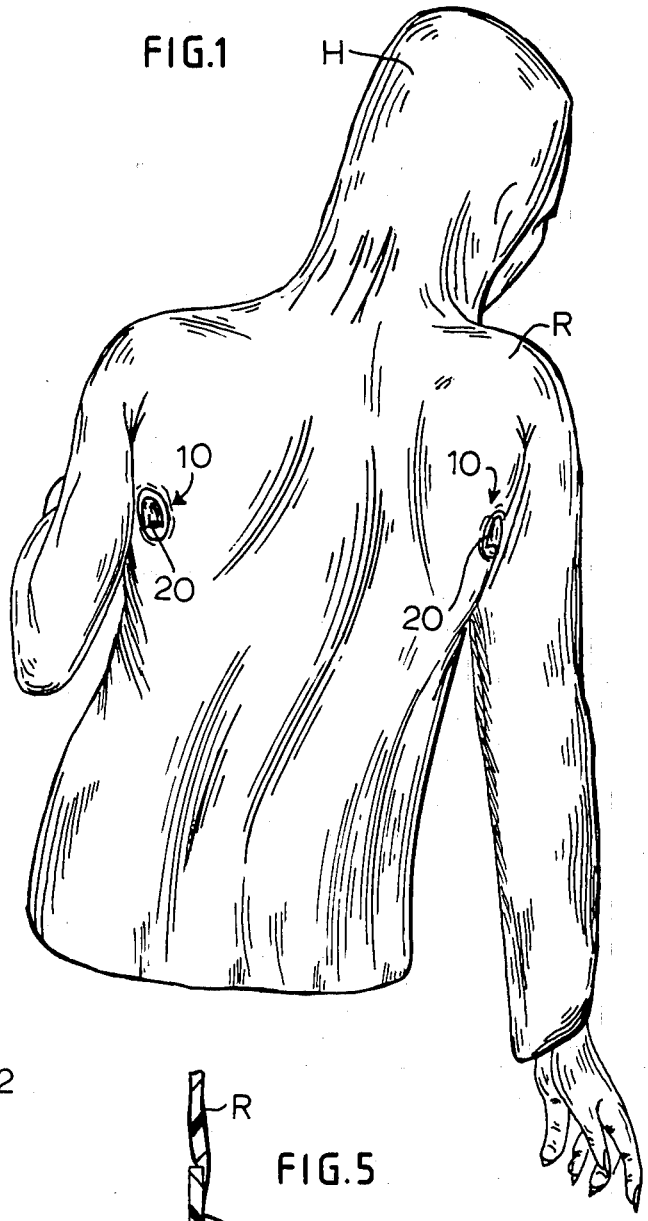
FIG. 1 is a perspective view, as seen from the rear, of an article of rainwear having air vents constructed in accordance with the present invention connected therein.

Accordingly, an air vent constructed in accordance with the present invention is adapted to be connected to an article of rainwear designated by the reference character R in FIG. 1. The article R is provided with a unitary hood portion H which is received over the head of the wearer. Although the article R shown in FIG. 1 is a jacket-type article of rainwear, it will be obvious that the air vent of the present invention may be used with any type of rainwear or, for that matter, any type of article which is utilized to cover or enclose a device, such as a tent or a surrounding wrap for machinery.

Rainwear R of the type shown is usually constructed of a plastic material such as polyvinyl chloride. This type of material although totally waterproof and, therefore, an excellent selection for rainwear, has the disadvantage that the material does not permit the passage of air therethrough. That is, the material does not "breathe". As a result, air vents must be provided to permit the flow of air to enter and exit the interior of the article, otherwise the article forms condensation on its inner wall and body heat causes perspiration build-up and discomfort.

Accordingly, air vents such as the vents 10 are provided in the article to provide for proper air flow from the interior to the environment, and from the environment to the interior. Although two such vents are shown on the article R, it is to be noted that this is for illustrative purposes only and is not to be interpreted as being a limitation of the present invention since any number of vents can be used.

The air vent 10 comprises a member 12 which may be in the form of a circular member or disk. A central portion 14 of the member 12 is depressed rearwardly to form a rearwardly extending projection. Alternatively, the member may be molded in this shape. The member 14 is in the shape of a bowl section whereby the greatest rearward dimension is at the point 16 and the surface curves rearwardly inwardly from that point. A through opening 18 is provided adjacent the depressed portion 14.

Connected to the other side of the member 12 is a cover 20. The cover 20 is curved and is connected to the member 12 just above the opening 18 and extends outwardly and downwardly to cover the opening 18 to prevent the entry of rain through the opening 18.

Figure 2:
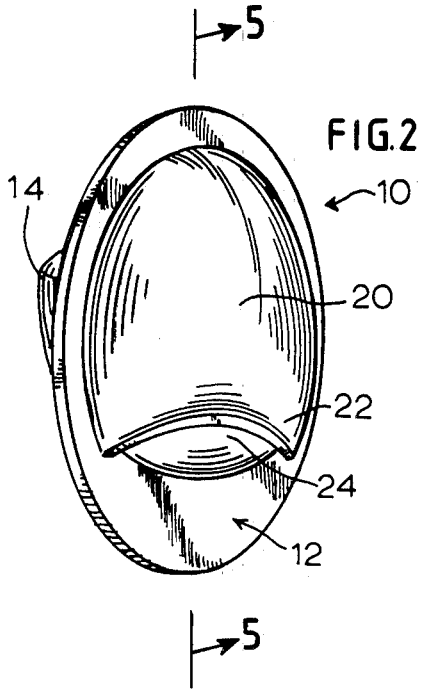
FIG. 2 is a perspective view, as seen from the outside, of the air vent shown in FIG. 1.
Figure 5:
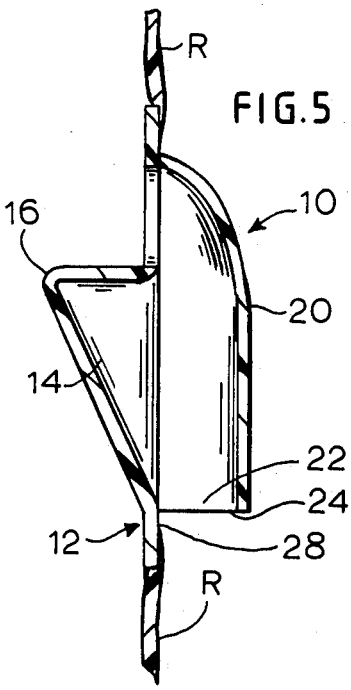
FIG. 5 is a sectional view taken along the line 5—5 of FIG. 2, with the surrounding portions of the article to which the air vent is connected shown therein.

As shown in FIGS. 2 and 5, the bottommost or skirt portion 22 of the cover 20 is spaced outwardly from the member 12 to provide a bottom opening 24 through which air can enter or exit. Additionally, the cover 20 curves upwardly to shield opening 18 from the entrance of rain.

Figure 3:
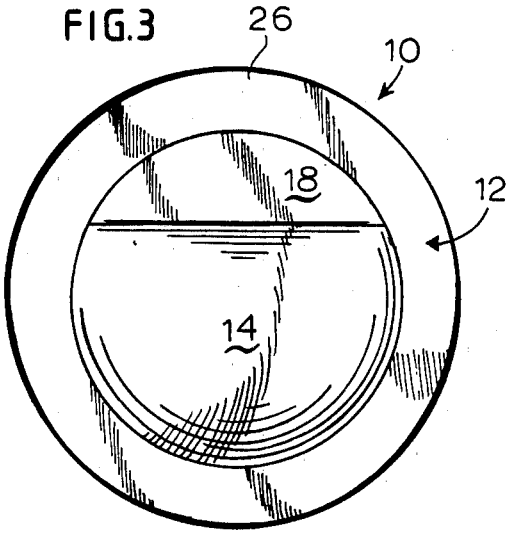
FIG. 3 is a rear elevational view thereof.
Figure 4:
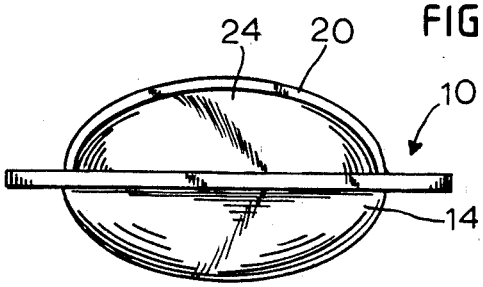
FIG. 4 is a bottom view thereof.

As shown in FIG. 3, the member 12 is provided with a peripheral heat sealing flange 26 which connects to the article R. More specifically, the air vent 10 is fabricated from a deformable material so it lends itself to hear sealing processes. One such material is a plastic material such as polyvinyl chloride.

When fabricating the air vent 10, the central portion 14 is formed in the mold as part of the member 12 and the cover 20 is connected to the member 12 by heat sealing the same thereto.

The rainwear R is provided with apertures 28 in a planar portion thereof. The diameter of the aperture 28 is slightly smaller than the diameter of the flange 26. Accordingly, when the air vent 10 is positioned within the aperture 28, the flange 26 will extend beyond the edges of the openings 28. That is, the edges of the rainwear R adjacent the opening 28 will overlap slightly the flange 26. Accordingly, the flange 26 may then be heat sealed to the article R in the conventional manner.

When the article R is worn on the body, the rearwardly extending projections 14 will engage the body and space the air vent away from the body to permit the flow of air through the opening 18 and out of the bottom opening 24 of the cover 20. The cover 20 will prevent the entry of rain into the interior of the garment.

Figure 4A:
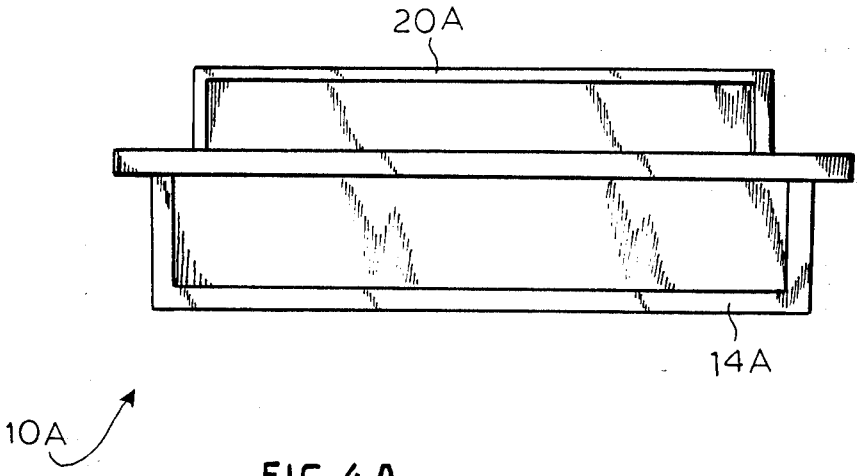
FIG. 4A is a bottom view of a modified embodiment of an air vent constructed in accordance with the present invention.

FIG. 4A illustrates a modified embodiment of the present invention. Thus, vent 10A includes the section 14A which is in the form of a box or rectangle rather than the bowl-shaped depression 14 shown in FIGS. 2–5. Additionally, the cover 20A may also be in the shape of a rectangle. Accordingly, the air vent 10A having the portions 14A and 20A may be utilized in all instances where the air vent 10 may be used.

While air vents constructed in accordance with the present invention have been shown and described herein, it will become obvious that numerous changes, additions and omissions may be made in such embodiments without departing from the spirit and scope of the present invention.

What is claimed is:

1. An air vent for an article adapted to cover a device wherein said article has at least a planar surface having an aperture; said air vent comprising:

a planar member having a rearwardly extending projection adapted to engage the device to space the aperture therefrom to permit the flow of air therethrough;

a through opening in said member spaced above said projection;

a forwardly projecting cover on the other side of said member covering said opening to prevent the entry of rain therethrough, said cover extending outwardly from a point above said opening and downwardly therefrom to a point spaced below said opening, said cover having a skirt portion which is spaced from said member to define a bottom opening therebetween;

and a peripheral flange on said member adapted to engage the edges of said article adjacent said aperture to position said air vent in said aperture.

2. An air vent as in claim 1, and sealing means for sealingly connecting said flange to the edges of said article.

3. An air vent as in claim 1, in which said air vent is fabricated from a deformable material.

4. An air vent as in claim 3, in which said rearwardly extending projection comprises a central portion of said member extending rearwardly from the plane of said member and integral therewith.

5. An air vent as in claim 4, in which said opening is adjacent said central portion.

6. An air vent as in claim 4, in which the largest rearward dimension of said central portion is adjacent said opening, and the outer edges of said central portion curve radially inwardly therefrom.

7. An air vent as in claim 6, in which said deformable material is plastic.

* * * * *